US005585336A

United States Patent [19]

Ozaki et al.

[11] Patent Number: 5,585,336

[45] Date of Patent: Dec. 17, 1996

[54] GREASE COMPOSITION FOR TRIPOD TYPE CONSTANT VELOCITY JOINT

[75] Inventors: Takahiro Ozaki; Fumio Goto; Yasushi Kawamura; Tomoo Munakata; Tetsuo Tsuchiya, all of Tokyo; Toshiharu Kato, Shizuoka; Shin Tomogami, Shizuoka; Shinichi Takabe, Shizuoka, all of Japan

[73] Assignees: Showa Shell Sekiyu K.K., Tokyo; NTN Corporation, Osaka, both of Japan

[21] Appl. No.: 539,742

[22] Filed: Oct. 5, 1995

[30] Foreign Application Priority Data

Oct. 5, 1994 [JP] Japan ..... 6-266345

[51] Int. Cl.[6] ..... C10M 141/02; C10M 141/06; C10M 141/08; C10M 141/10

[52] U.S. Cl. ..... 508/365; 508/375

[58] Field of Search ..... 252/32.7 E, 46.4, 252/51.5 A; 508/365, 375

[56] References Cited

U.S. PATENT DOCUMENTS

| | | | |
|---|---|---|---|
| 3,203,897 | 8/1965 | Ambrose et al. | 252/32.7 |
| 3,300,409 | 1/1967 | Butler | 252/32.7 |
| 3,360,463 | 12/1967 | Jacques | 252/32.7 |
| 3,400,140 | 9/1968 | Rowan et al. | 260/429 |
| 3,840,463 | 10/1974 | Froeschmann et al. | 252/42.7 |
| 3,925,213 | 12/1975 | Froeschmann et al. | 252/18 |
| 4,370,245 | 1/1983 | Ryu et al. | 252/46.4 |
| 4,383,931 | 5/1983 | Ryu et al. | 252/32.7 |
| 4,392,966 | 7/1983 | Schlicht | 252/32.7 |
| 4,551,258 | 11/1985 | Ikeda et al. | 252/32.7 |
| 4,840,740 | 6/1989 | Sato | 252/32.7 |
| 5,160,645 | 11/1992 | Okaniwa et al. | 252/32.7 E |
| 5,207,936 | 5/1993 | Anzai et al. | 252/25 |
| 5,462,683 | 10/1995 | Kinoshita et al. | 252/25 |

FOREIGN PATENT DOCUMENTS

| | | | |
|---|---|---|---|
| 1089463 | 11/1967 | United Kingdom | C10M 5/24 |
| 1136723 | 12/1968 | United Kingdom | C10M 1/48 |

*Primary Examiner*—Margaret Medley
*Attorney, Agent, or Firm*—Sughrue, Mion, Zinn, Macpeak & Seas

[57] ABSTRACT

A grease composition for a tripod type constant velocity joint, which includes a base oil, a urea compound as a thickening agent, and not more than 10% by weight of at least one of (A) a molybdenum dialkyldithiocarbamate and (B) a molybdenum dialkyldithiophosphate or diaryldithiophosphate, in which the base oil has a kinematic viscosity of from 3.0 to 7.5 $mm^2$/sec at 100° C. The grease composition applied to a tripod type constant velocity joint reduces the induced thrust force and thereby suppresses vibration, such as a shudder of a car body upon starting off and acceleration.

6 Claims, 1 Drawing Sheet

GREASE COMPOSITION FOR TRIPOD TYPE CONSTANT VELOCITY JOINT

FIELD OF THE INVENTION

This invention relates to a grease composition applied to a sliding part of a tripod type constant velocity joint (hereinafter abbreviated as CVJ) of automobiles.

BACKGROUND OF THE INVENTION

With the recent trend to a front wheel front drive (FF) system of automobiles, the use of a CVJ which can evenly transmit the power of an engine to rotate right and left wheels at a given velocity has been increasing rapidly. In particular, a tripod type CVJ has a structure shown in FIGS. 1 and 2, in which outer ring 11 has on the inner side thereof three cylindrical grooved tracks 12 in the axial direction at equally divided angles, and tripod member 13 fitted into outer ring 11 has three axial feet 14. Spherical-surfaced roller 15 is fitted onto the outer side of each axial foot. A number of needle bearings 16 are fitted between spherical-surfaced roller 15 and axial foot 14 to bear spherical-surfaced roller 15 in such a manner that the roller may rotate and slide in the axial direction. Spherical-surfaced roller 15 is fitted into grooved track 12. Such a tripod type CVJ is apt to generate a resisting force in its axial direction because of the involvement of reciprocating rolling and sliding between cylindrical groove 12 and spherical-surfaced roller 15 on revolution. This force (hereinafter referred to as induced thrust force) causes vibration, such as a shudder of the car body upon starting off and acceleration.

Therefore, grease to be applied to a tripod type CVJ is keenly demanded to reduce frictional resistance of the sliding part. Grease having excellent lubricating action not only reduces the above-described vibration but also suppresses frictional heat generation, thereby leading to improved durability of the CVJ.

In order to meet the above demand, cases are increasing in the market in which urea grease having high heat resistance and excellent frictional wear characteristics is used. The grease compositions disclosed in JP-A-2-20597 (the term "JP-A" as used herein means an "unexamined published Japanese patent application") and JP-B-5-79280 (the term "JP-B" as used herein means an "examined Japanese patent publication") may be mentioned as typical examples of the art.

The grease composition of JP-A-2-20597 comprises a base oil, a thickening agent comprising a diurea compound, a urea-urethane compound, and a diurethane compound, a sulfurphosphorus type extreme pressure additive consisting of (1) an alkali metal borate hydrate, (2) at least one molybdenum compound selected from a molybdenum dithiophosphate (Mo-DTP), molybdenum dithiocarbamate (Mo-DTC), and molybdenum disulfide ($MoS_2$), and (3) at least one compound selected from the group consisting of sulfated fat and oil, polysulfide, a phosphate, a phosphite, a thiophosphate, and zinc dithiophosphate.

The grease composition of JP-B-5-79280 is for a CVJ and comprises urea grease and, as additives, Mo-DTC and Mo-DTP or a combination of these organomolybdenum compounds and zinc dithiophosphate (Zn-DTP).

However, when these conventional grease compositions are applied to a tripod type CVJ, they are not regarded as satisfactory because vibration still occurs in the shaft, although the induced thrust force is lower than that generated in using commercially available grease.

SUMMARY OF THE INVENTION

An object of the present invention is to provide grease for a tripod type CVJ which, when applied to a tripod type CVJ, remarkably reduces the induced thrust force and thereby suppresses vibration, such as a shudder of a car body upon starting off and acceleration.

The inventors of the present invention have extensively studied to further improve the technique of JP-B-5-79280 taking fluidity characteristics of grease into consideration. As a result, they have found that a base oil having a kinematic viscosity lower than that of a base oil generally used for a CVJ, i.e., 10 to 15.7 $mm^2$/sec at 100° C., is very effective for the reduction of induced thrust force and improvement of durability of a tripod type CVJ. The present invention has been completed based on this finding. It seems that use of a base oil having a low viscosity facilitates the supply of grease to the sliding part of a joint to reduce the friction, which reduces the vibration of the shaft and also suppresses a temperature increase in the CVJ, thereby increasing the durability of the CVJ.

The present invention relates to a grease composition for a tripod type CVJ (a tripod CVJ) which comprises a base oil, a thickening agent comprising a urea compound, and not more than 10% by weight, based on the total weight of the composition, of at least one of (A) a molybdenum dialkyldithiocarbamate and (B) a molybdenum dialkyldithiophosphate or diaryldithiophosphate represented by formula (I):

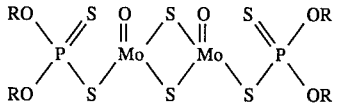

(I)

wherein R represents a primary or secondary alkyl or aryl group, in which the base oil has a kinematic viscosity of from 3.0 to 7.5 $mm^2$/sec at 100° C.

In a preferred embodiment of the present invention, the grease composition further comprises (C) not more than 15% by weight, based on the total weight of the composition, of a zinc dialkyldithiophosphate or diaryldithiophosphate represented by formula (II):

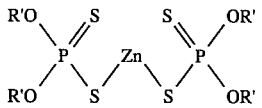

(II)

wherein R' represents a primary or secondary alkyl or aryl group.

DETAILED DESCRIPTION OF THE INVENTION

Figure 1:
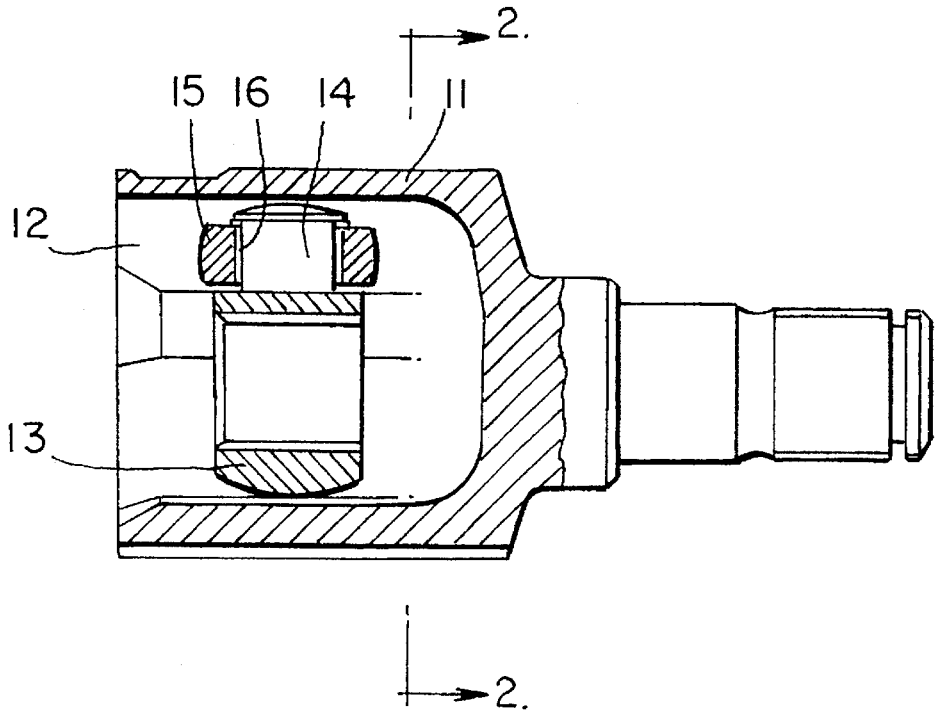
FIG. 1 is a cross-sectional view of a tripod type CVJ with a portion thereof omitted.
Figure 2:
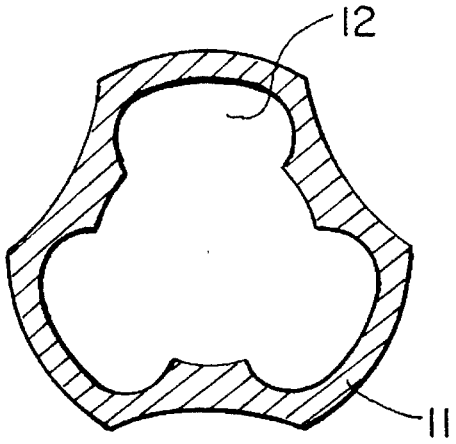
FIG. 2 is a cross-section taken along line Z—Z' of FIG. 1.

The grease of the present invention is characterized in that the base oil used has a kinematic viscosity of 3.0 to 7.5 $mm^2$/sec, preferably 4.0 to 5.5 $mm^2$/sec, at 100° C., while any base oil conventionally used for a CVJ has the viscosity of 10 to 16 $mm^2$/sec. Thus, grease can be supplied smoothly to the sliding part of a tripod type CVJ to provide better lubrication and effectively reduce the induced thrust force. Further, the increase in temperature due to frictional wear can be inhibited to make a contribution to improvement of durability. If the kinematic viscosity of the base oil is as low as less than 3.0 at 100° C., such a base oil has a low ignition point, making grease production difficult.

The base oil which can be used in the present invention is not limited in kind as long as the above kinematic viscosity requirement is fulfilled, and any of mineral oils, synthetic hydrocarbon oils and mixtures thereof may be used.

As the thickening agent, urea compounds can be used in the present invention. The urea compound to be used may be of any type. Diurea compounds and/or tetraurea compounds are particularly preferred. When other compounds are used as the thickening agent, heat resistance and lubricity of the resulting compositions are deteriorated.

The total content of additives (A) and (B) should be not more than 10% by weight, preferably 3 to 5% by weight, based on the total weight of the grease composition. Even if the content is more than 10% by weight, the effects produced are the same or rather reduced.

The content of additive (C) should be not more than 15% by weight, preferably not more than 5% by weight, based on the total weight of the grease composition. Even if the content is more than 15% by weight, the effects produced are the same or rather reduced.

Where additives (A), (B), and (C) are used in combination, extremely excellent effects can be obtained even if the amount of each additive is minimized. In this case, the highest efficiency results when each additive is used in an amount of 0.5 to 5.0% by weight.

Other optional additives, such as antioxidants and detergent-dispersants, may be added appropriately to the grease of the present invention without impairing the effects of the present invention.

The molybdenum dialkyldithiocarbamate as additive (A) includes molybdenum diethyldithiocarbamate sulfide, molybdenum dipropyldithiocarbamate sulfide, molybdenum dibutyldithiocarbamate sulfide, molybdenum dipentyldithiocarbamate sulfide, molybdenum dihexyldithiocarbamate sulfide, molybdenum dioctyldithiocarbamate sulfide, molybdenum didecyldithiocarbamate sulfide, molybdenum didodecyldithiocarbamate sulfide, molybdenum di(butylphenyl)dithiocarbamate sulfide, molybdenum di(nonylphenyl)dithiocarbamate sulfide, oxymolybdenum diethyldithiocarbamate sulfide, oxymolybdenum dipropyldithiocarbamate sulfide, oxymolybdenum dibutyldithiocarbamate sulfide, oxymolybdenum dipentyldithiocarbamate sulfide, oxymolybdenum dihexyldithiocarbamate sulfide, oxymolybdenum dioctyldithiocarbamate sulfide, oxymolybdenum didecyldithiocarbamate sulfide, oxymolybdenum didodecyldithiocarbamate sulfide, oxymolybdenum di(butylphenyl)dithiocarbamate sulfide, and oxymolybdenum di(nonylphenyl)dithiocarbamate sulfide, and mixtures thereof.

Examples of R in formula (I) representing additive (B) are methyl, ethyl, propyl, butyl, pentyl, hexyl, heptyl, octyl, nonyl, decyl, dodecyl, tetradecyl, hexadecyl, octadecyl, eicosyl, docosyl, tetracosyl, cyclopentyl, cyclohexyl, methylcyclohexyl, ethylcyclohexyl, dimethylcyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl, and phenethyl groups. The plural R groups may be the same or different. Preferably, R has 1 to 30 carbon atoms.

Specific examples of additive (B) include molybdenum diethyldithiophosphate sulfide, molybdenum dipropyldithiophosphate sulfide, molybdenum dibutyldithiophosphate sulfide, molybdenum dipentyldithiophosphate sulfide, molybdenum dihexyldithiophosphate sulfide, molybdenum dioctyldithiophosphate sulfide, molybdenum didecyldithiophosphate sulfide, molybdenum didodecyldithiophosphate sulfide, molybdenum di(butylphenyl)dithiophosphate sulfide, molybdenum di(nonylphenyl)dithiophosphate sulfide, oxymolybdenum diethyldithiophosphate sulfide, oxymolybdenum dipropyldithiophosphate sulfide, oxymolybdenum dibutyldithiophosphate sulfide, oxymolybdenum dipentyldithiophosphate sulfide, oxymolybdenum dihexyldithiophosphate sulfide, oxymolybdenum dioctyldithiophosphate sulfide, oxymolybdenum didecyldithiophosphate sulfide, oxymolybdenum didodecyldithiophosphate sulfide, oxymolybdenum di(butylphenyl)dithiophosphate sulfide, and oxymolybdenum di(nonylphenyl)dithiophosphate sulfide.

Examples of R' in formula (II) representing additive (C) are methyl, ethyl, propyl, isopropyl, butyl, sec-butyl, isobutyl, pentyl, 4-methylpentyl, hexyl, 2-ethylhexyl, heptyl, octyl, nonyl, decyl, isodecyl, dodecyl, tetradecyl, hexadecyl, octadecyl, eicosyl, docosyl, tetracosyl, cyclopentyl, cyclohexyl, methylcyclohexyl, ethylcyclohexyl, dimethylcyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl, and phenethyl groups. The plural R' groups may be the same or different. Preferably, R' has 3 to 18 carbon atoms.

Specific examples of additive (C) include zinc diisopropyldithiophosphate, zinc diisobutyldithiophosphate, zinc diisodecyldithiophosphate, zinc di-p-dodecylphenoldithiophosphate, zinc diheptylphenoldithiophosphate, and zinc di-p-nonylphenoldithiophosphate.

The present invention will now be illustrated in greater detail by way of Examples and Comparative Examples, but it should be understood that the present invention is not to be construed as being limited thereto. Unless otherwise indicated, all parts, percents, ratios and the like are given by weight.

EXAMPLES 1 TO 10 AND COMPARATIVE EXAMPLES 1 TO 8

Base grease I, II or III described below was uniformly mixed with at least one additive selected from a molybdenum dialkyldithiocarbamate and a molybdenum dialkyl(or diaryl)dithiophosphate and, in some cases, a zinc dialkyl(or diaryl)dithiophosphate in a three-roll mill to prepare a grease composition shown in Tables 1 and 2.

Base Grease

I. Diurea Grease

One mole of 4,4'-diphenylmethane diisocyanate and 2 mols of oleylamine were reacted in a base oil as shown in Tables 1 and 2, and the resulting urea compound was uniformly dispersed in the base oil to obtain grease. The content of the urea compound in the total grease composition was adjusted to 10%.

II. Tetraurea Grease

Two moles of 4,4'-diphenylmethane diisocyanate, 2 mols of stearylamine, and 1 mol of ethylenediamine were reacted in a base oil as shown in Tables 1 and 2, and the resulting urea compound was uniformly dispersed in the base oil to obtain grease. The content of the urea compound in the total grease composition was adjusted to 15%.

III. Lithium Soap Grease

Lithium 12-hydroxystearate was dissolved and uniformly dispersed in a base oil as shown in Table 2 to obtain lithium soap grease. The soap content in the total grease composition was adjusted to 8%.

Each of the grease compositions prepared was applied to a tripod type CVJ and tested under the following conditions to measure the induced thrust force and durability. The results obtained are shown in Tables 1 and 2. The term "induced thrust force" as used herein means the force imposed on a shaft when a rotational torque is transmitted at a certain angle without sliding the driving shaft and the driven shaft of the tripod CVJ into the axial direction.

Conditions for Measuring Induced Thrust Force

CVJ: Tripod type
Rotational torque: 588 N·m (60 kgf·m)
Number of revolutions: 150 rpm
Angle: 7°

Conditions for Measuring Durability

CVJ: Tripod type
Rotational torque: 706 N·m (72 kgf·m)
Number of revolutions: 250 rpm
Angle: 6.0°
Operating time: 250 hrs Grease compositions which caused no damage to the joint were "accepted", and those which caused damage to the joint were "rejected".

TABLE 1

| | Example No. | | | | | | | | | |
|---|---|---|---|---|---|---|---|---|---|---|
| | 1 | 2 | 3 | 4 | 5 | 6 | 7 | 8 | 9 | 10 |
| Composition (wt %): | | | | | | | | | | |
| I. Diurea grease | 95 | 95 | 94 | 94 | | | | | 94 | 94 |
| II. Tetraurea grease | | | | | 96 | 94 | 93 | 91 | | |
| Mo-DTC[1)] | 3 | 3 | 3 | 3 | 3 | 3 | 2 | 5 | 3 | 3 |
| Mo-DTP[2)] | 2 | | 2 | | 1 | 2 | | 1 | 2 | 2 |
| Mo-DTP[3)] | | 2 | | 2 | | | 3 | | | |
| Zn-DTP[4)] | | | 1 | | | 1 | | 3 | 1 | 1 |
| Zn-DTP[5)] | | | | 1 | | | 2 | | | |
| Base oil: | | | | | | | | | | |
| Kind | mineral oil | mineral oil | mineral oil | mineral oil | mineral oil | mineral oil | mineral oil | mineral oil | PAO[6)] | mineral oil |
| Viscosity (100° C.; $mm^2$/sec) | 5.5 | 5.5 | 5.5 | 5.5 | 5.5 | 5.5 | 5.5 | 5.5 | 3.5 | 7.5 |
| Viscosity index | 103 | 103 | 103 | 103 | 103 | 103 | 103 | 103 | 121 | 102 |
| Test Results: | | | | | | | | | | |
| Penetration Worked (60 W, 25° C.) | 307 | 311 | 313 | 308 | 305 | 314 | 309 | 306 | 330 | 308 |
| Dropping Point (°C.) | 259 | 256 | 258 | 255 | 246 | 246 | 246 | 244 | 251 | 260 |
| Induced thrust force (N) | 90 | 91 | 88 | 90 | 94 | 91 | 92 | 89 | 76 | 105 |
| Durability | accepted | accepted | accepted | accepted | accepted | accepted | accepted | accepted | accepted | accepted |

TABLE 2

| | Comparative Example No. | | | | | | | |
|---|---|---|---|---|---|---|---|---|
| | 1 | 2 | 3 | 4 | 5 | 6 | 7 | 8 |
| Composition (wt %): | | | | | | | | |
| I. Diurea grease | 94 | | 94 | | 94 | | | |
| II. Tetraurea grease | | 94 | | 94 | | 94 | | |
| III. Lithium soap grease | | | | | | | 94 | 93 |
| Mo-DTC[1)] | 3 | 3 | 3 | 3 | 3 | 3 | 3 | 3 |
| Mo-DTP[2)] | 2 | | | 2 | 2 | | 2 | |
| Mo-DTP[3)] | | 2 | 2 | | | 2 | | 3 |
| Zn-DTP[4)] | 1 | 1 | | 1 | 1 | 1 | 1 | |
| Zn-DTP[5)] | | | 1 | | | | | 1 |
| Base oil: | | | | | | | | |
| Kind | mineral oil | mineral oil | mineral oil | mineral oil | mineral oil | mineral oil | mineral oil | mineral oil |

TABLE 2-continued

| | Comparative Example No. | | | | | | | |
|---|---|---|---|---|---|---|---|---|
| | 1 | 2 | 3 | 4 | 5 | 6 | 7 | 8 |
| Viscosity (100° C.; $mm^2$/sec) | 10 | 10 | 12 | 12 | 15 | 15 | 5.5 | 5.5 |
| Viscosity index | 99 | 99 | 98 | 98 | 99 | 99 | 103 | 103 |
| Test Results: | | | | | | | | |
| Penetration Worked (60 W, 25° C.) | 301 | 305 | 308 | 310 | 298 | 306 | 303 | 295 |
| Dropping Point (°C.) | 259 | 243 | 256 | 245 | 260 | 243 | 195 | 187 |
| Induced thrust force (N) | 127 | 122 | 115 | 117 | 116 | 121 | 151 | 157 |
| Durability | rejected | rejected | rejected | rejected | rejected | rejected | — | — |

Note:
1): Sakuralube 600, produced by Asahi Denka Kogyo K.K.
2): Sakuralube 300, produced by Asahi Denka Kogyo K.K.
3): Molyvan L, produced by R. T. Vanderbilt Co. Inc.
4): Lubrizol 1097, produced by Lubrizol K.K.
5): Lubrizol 1370, produced by Lubrizol K.K.
6): Poly-α-olefin oil As is apparent from Tables 1 and 2, the tripod type CVJ filled with the grease composition of the present invention shows an extremely low induced thrust force, hardly generating vibration of the shaft, and also exhibits excellent durability. Since Comparative Example Nos. 7 and 8 had extremely high induced thrust force, durability test as to these examples was not conducted.

As described and demonstrated above, since the grease composition of the present invention contains a base oil which has a kinematic viscosity that is considerably lower than the kinematic viscosity of base oils conventionally used in grease for a tripod type CVJ, it is capable of reducing the induced thrust force of a tripod type CVJ from 115 N or higher, as has been the case with the conventional grease, to about 105 N or lower. Further, since the base oil used in the present invention has a relatively low viscosity, the grease can be smoothly supplied to the sliding part of the CVJ, thereby providing the CVJ with an extended duration, i.e., life until the CVJ is damaged.

While the invention has been described in detail and with reference to specific examples thereof, it will be apparent to one skilled in the art that various changes and modifications can be made therein without departing from the spirit and scope thereof.

What is claimed is:

1. A grease composition for a tripod constant velocity joint, which comprises a base oil, a urea compound thickening agent, and not more than 10% by weight, based on the total weight of the composition, of a mixture of (A) molybdenum dialkyldithiocarbamate and (B) at least one organic molybdenum compound selected from the group consisting of molybdenum dialkyldithiophosphate and molybdenum diaryldithiophosphate represented by formula (I):

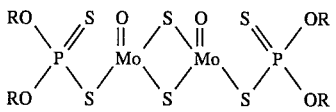

(I)

wherein R represents a primary or secondary alkyl or aryl group, in which said base oil has a kinematic viscosity of from 3.0 to 7.5 $mm^2$/sec at 100° C. and wherein an induced thrust force of a tripod constant velocity joint filled with said grease composition is not more than 105 Newtons.

2. A grease composition according to claim 1, wherein said composition further comprises (C) not more than 15% by weight, based on the total weight of the composition, of a zinc dialkyldithiophosphate or diaryldithiophosphate represented by formula (II):

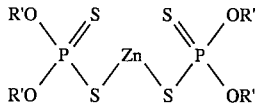

(II)

wherein R' represents a primary or secondary alkyl or aryl group.

3. A grease composition according to claim 2, wherein additives (A), (B), and (C) are each present in an amount of 0.5 to 5.0% by weight based on the total weight of the composition.

4. A grease composition according to claim 1, wherein the urea compound is selected from the group consisting of diurea compounds and tetraurea compounds.

5. A grease composition according to claim 1, wherein each of additives (A) and (B) is used in an amount of 0.5 to 5.0% by weight based on the total weight of the composition.

6. A grease composition according to claim 2, wherein additive (C) is used in an amount of not more than 5.0% by weight based on the total weight of the composition.

* * * * *